US008290396B2

(12) United States Patent
Lee et al.

(10) Patent No.: US 8,290,396 B2
(45) Date of Patent: Oct. 16, 2012

(54) IMAGE FORMING APPARATUS

(75) Inventors: Sung-Kyun Lee, Seoul (KR); Myoung-Sub Jang, Suwon-si (KR); Seung-Kyu Lee, Hwaseong-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 365 days.

(21) Appl. No.: 12/760,326

(22) Filed: Apr. 14, 2010

(65) Prior Publication Data

US 2011/0076055 A1 Mar. 31, 2011

(30) Foreign Application Priority Data

Sep. 28, 2009 (KR) ..... 10-2009-0091545

(51) Int. Cl.
*G03G 21/16* (2006.01)
*G03G 15/00* (2006.01)

(52) U.S. Cl. ..... 399/111; 399/110

(58) Field of Classification Search ..... 399/110, 399/111
See application file for complete search history.

(56) References Cited

U.S. PATENT DOCUMENTS

| | | | | |
|---|---|---|---|---|
| 6,980,758 | B2 * | 12/2005 | Murayama et al. | 399/111 |
| 7,187,886 | B2 * | 3/2007 | Kawasumi | 399/111 |
| 7,272,341 | B2 * | 9/2007 | Jung et al. | 399/111 |
| 7,336,916 | B2 * | 2/2008 | Jung et al. | 399/111 |
| 7,664,427 | B2 * | 2/2010 | Kawasumi et al. | 399/110 |
| 7,711,287 | B2 * | 5/2010 | Kimizuka et al. | 399/111 |

* cited by examiner

*Primary Examiner* — Sandra Brase
(74) *Attorney, Agent, or Firm* — Stanzione & Kim, LLP

(57) ABSTRACT

Disclosed is an image forming apparatus that includes a body housing having an opening and a cover covering the opening, a body frame in the body housing for supporting thereon various component parts of the image forming apparatus, an image forming cartridge receivable into the body housing through the opening to be detachably supported on the body frame and a support assembly supporting the mounted image forming cartridge. The support assembly includes a locking member movable between a locking position at which the image forming cartridge is limited in its movement along the direction of separating away from the body frame and a releasing position at which the image forming cartridge is allowed to move away from the body frame. The support assembly further includes an elastic member elastically biasing the locking member to the releasing position and a pressing member provided on the cover for pressing the locking member to remain in the locking position when the covered is closed to cover the opening.

17 Claims, 8 Drawing Sheets

IMAGE FORMING APPARATUS

CROSS-REFERENCE TO RELATED APPLICATION

This application claims priority from Korean Patent Application No. 10-2009-0091545, filed on Sep. 28, 2009 in the Korean Intellectual Property Office, the disclosure of which is incorporated herein by reference.

TECHNICAL FIELD

The present disclosure relates generally to an image forming apparatus with a detachable cartridge, and, more particularly, to an image forming apparatus having an improved structure for secure mounting of the detachable cartridge.

BACKGROUND OF RELATED ART

An image forming apparatus forms an image on a recording medium using developer or ink. After a period of operation, the supply of the developer may become exhausted or component members may become worn out, resulting in poor image quality or even the inability to form any additional images. Some components of the image forming apparatus, e.g., the container for the supply of developer or an image holding member, are provided as replaceable cartridges that can be removed from the housing or the main body of the image forming apparatus for replacement with new cartridges.

Such detachable cartridges may however experience some movement from the intended operational mounting position, for example, due to the vibration during the image forming operations or an external impact. An image forming apparatus thus typically adopts some structure for preventing the cartridge from becoming detached by such movements.

Such detachment preventive structure generally includes the cartridge being pressed by an elastic force, for example, of a spring, and thus requires a user to exert some force to overcome the elastic force when mounting the cartridge into the main body. As the elastic force becomes greater to improve the secure mounting of the cartridge, the user is required to exert a greater mounting force, increasing the likelihood of the improper or incomplete mounting of the cartridge. Such improperly or incompletely mounted cartridge may result in the defects in the resulting image on the recording medium, malfunctioning of the image forming apparatus or even in a permanent damage to the image forming apparatus due to misalignment with other components.

SUMMARY OF DISCLOSURE

According to an aspect of the present disclosure, there may be provided an image forming apparatus that may include a body housing, a body frame, an image forming cartridge and a support assembly. The body housing may have an opening and a cover configured to selectively cover the opening. The body frame may be arranged in the body housing for supporting thereon one or more components of the image forming apparatus. The image forming cartridge may be configured to form thereon a visible image and to be detachably mountable on the body frame, and may be receivable into the body housing through the opening. The support assembly may support the image forming cartridge mounted on the body frame, and may comprise a locking member, an elastic member and a pressing member. The locking member may be movable between a locking position at which the locking member prevents the image forming cartridge from moving in a direction away from the body frame and a releasing position at which the locking member allows the image forming cartridge to move away from the body frame. The elastic member may elastically bias the locking member toward the releasing position. The pressing member may be provided on the cover in such a manner that the pressing member presses on the locking member so as to cause the locking member to remain in the locking position when the cover is closed to cover the opening of the body housing.

The locking member may comprise a locking member body, a hinge movably coupling a first end portion of the locking member body to the body frame and a stopper formed at a second end portion opposite the first end portion of the locking member body. The stopper may be in an interfering contact with and thereby limiting movement of the image forming cartridge that is mounted on the body frame.

The image forming cartridge may comprise a cartridge housing and a cartridge pressed part formed on the cartridge housing. The cartridge pressed part may be configured to come into a locking contact with the stopper of the locking member.

The cartridge pressed part of the image forming cartridge and the stopper of the locking member may be configured and arranged such that, when the stopper is able to come into a contact with any portion of the cartridge pressed part, closing of the cover causes the pressing member to press the locking member to move toward the locking position, and in turn causes the image forming cartridge to move from a first position to a second position closer to the body frame through such contact between the stopper and the cartridge pressed part.

The locking member body may comprise a curved contact surface that comes into initial contact with the pressing member when the cover is being closed.

The locking member body may comprises an inclined contact surface that comes into initial contact with the pressing member when the cover is being closed.

The image forming apparatus may further comprise a transfer unit, which may be supported on the body frame to correspond to the image forming cartridge, and which may be configured to transfer the visible image from the image forming cartridge onto a recording medium. The support assembly may further comprise a cartridge pressing member arranged on the body frame. The cartridge pressing member may be configured to elastically press the image forming cartridge toward the transfer unit.

The cartridge pressing member may comprise an inclined contact guide surface that comes into initial contact with the image forming cartridge when the image forming cartridge is being received into the body housing.

The direction in which the cartridge pressing member elastically presses the image forming cartridge may be perpendicular to the direction in which the image forming cartridge is received into the body housing.

According to another aspect of the present disclosure, there may be provided an image forming apparatus having a housing with an opening through which to detachably receive a removable component unit of the image forming apparatus and a cover for selectively closing the opening. The image forming apparatus may include a support frame, a locking member, an elastic member and a pressing member. The support frame may be arranged in the housing, and may define a mounting position of the removable component unit at which the removable component unit received into the housing is to be operably supported on the support frame. The locking member may be configured to be movable between a locking position and a releasing position. The locking member may limit the movement of the removable component unit away from the mounting position when the locking member is in the locking position, and may allow the removable component unit to move away from the mounting position when the locking member is in the releasing position. The elastic member may elastically bias the locking member unit to move toward the releasing position. The pressing member may extend from the cover to be in a pressing contact with the locking member in such a manner to cause the locking member to remain in the locking position when the cover is closed.

The removable component unit may comprise an image forming cartridge that includes an image holding member having an image carrying surface on which an image formed of developer is to be supported.

The locking member may comprise a locking member body pivotally coupled to the support frame. The locking member body may have a stopper formed on an end portion thereof that is configured to come into contact with a portion of the removable component unit being received into the housing. The stopper may define a contact surface that extends perpendicular to the direction along which the removable component unit is received into the housing.

The locking member body may further comprise a contact guide surface configured to make an initial contact with the pressing member of the cover being closed. The contact guide surface may be curved to guide the pressing member to move slidingly thereon toward the support frame.

The locking member may be configured and arranged such that, when the locking member is able to come into a contact with any portion of the removable component unit, movement of the locking member toward the locking position urged by the pressing member of the cover being closed causes the removable component unit to move from a position away from the mounting position toward the mounting position to thereby be operably supported on the support frame in the mounting position when the cover is completely closed.

The image forming apparatus may further comprise an elastic pressing member that may be configured to elastically press the removable component unit received in the housing along a first direction perpendicular to a second direction along which the removable component unit is received into the housing.

The removable component unit may further comprise a developer container having stored therein a supply of developer and a development roller for conveying the developer from the developer container to the image carrying surface of the image holding member to thereby form thereon the image formed of developer.

The elastic member may comprise a torsion spring that biases the locking member to pivot about a hinged coupling with the support frame so as to move toward the locking position.

BRIEF DESCRIPTION OF THE DRAWINGS

Various features, aspects and advantages of the present disclosure will become more apparent by the following detailed description of several embodiments thereof with reference to the attached drawings, of which.

DETAILED DESCRIPTION OF SEVERAL EMBODIMENTS

Figure 1:
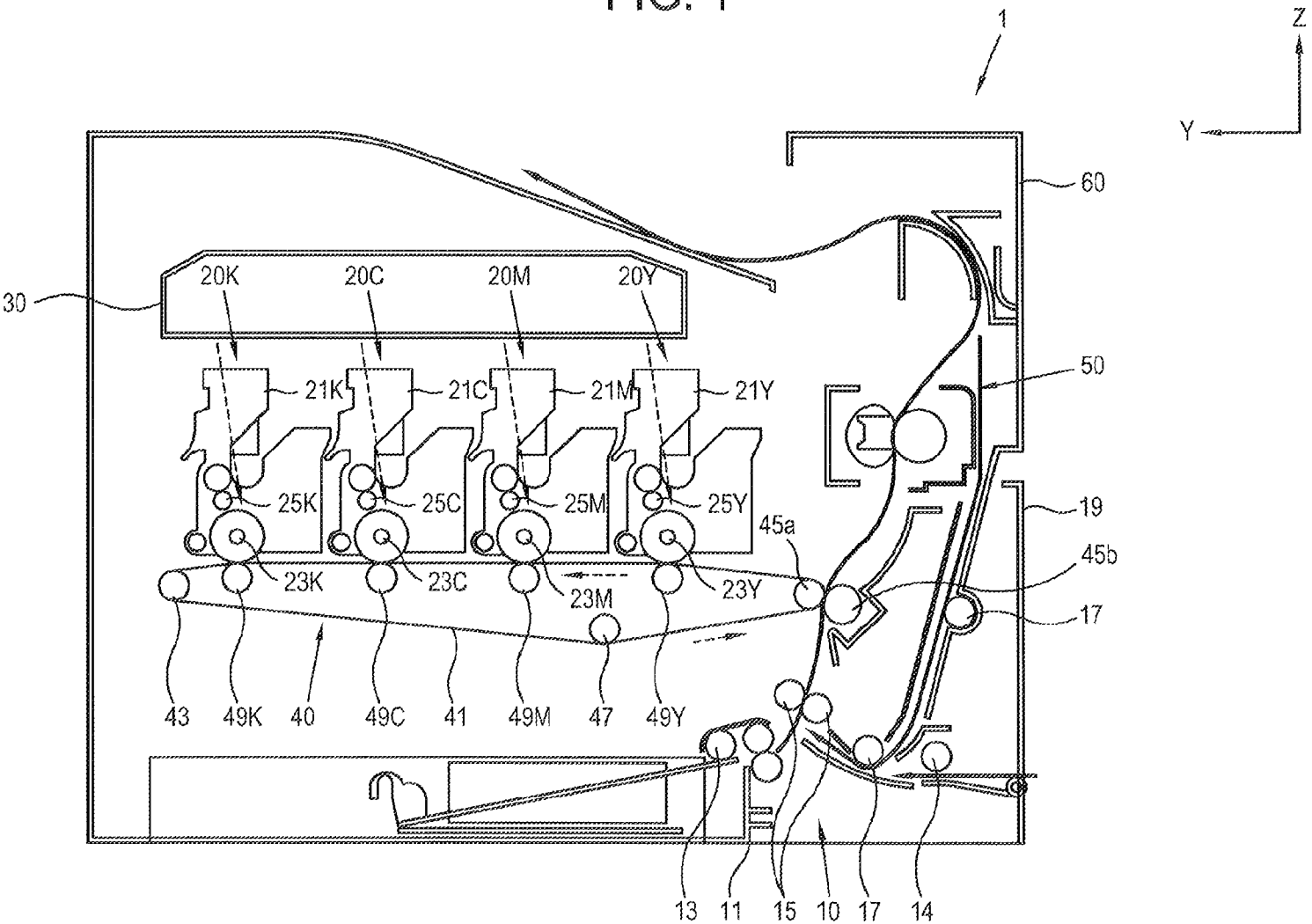
FIG. 1 is a lateral cross-sectional view of an image forming apparatus according to an embodiment of the present disclosure.

Reference will now be made in detail to several embodiments of the present invention, examples of which are illustrated in the accompanying drawings, wherein like reference numerals refer to like elements. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not necessarily intended to be to true scale and may be exaggerated for the sake of allowing greater understanding.

FIG. 1 is a lateral cross-sectional view that schematically illustrates an image forming apparatus according to an embodiment of the present disclosure. The image forming apparatus 1 according to an embodiment may include image holding members 23C, 23M, 23Y and 23K corresponding to developers of different colors, respectively, for forming color or black-and-white images. The image forming apparatus 1 shown in FIG. 1 is an example of an apparatus that employs an intermediate transfer method of transferring the image, in which the visible images are not transferred from the image holding members 23C, 23M, 23Y and 23K directly onto a recording medium (M), but are instead transferred first to an intermediate transfer medium such as, for example, an intermediate transfer belt 41, and are transferred to the recording medium (M) from the intermediate transfer member. It should be understood however that the intermediate transfer method of transferring images is described merely as an illustrative example, and that an image forming apparatus according to an alternative embodiments may not necessarily employ an intermediate transfer medium.

As shown in FIG. 1, the image forming apparatus 1 according to an embodiment may include a paper feeding unit 10 configured to accommodate a supply of recording media and to feed the recording medium (M) along the recording medium transport path defined in the body housing 60, image forming cartridges 20C, 20M, 20Y and 20K respectively having the image holding members 23C, 23M, 23Y and 23K for forming a visible image with developers of different colors, an exposure unit 30 configured to exposes the image holding members 23C, 23M, 23Y and 23K with light pattern that corresponds to an image data representative of the intended image to be formed, a transfer unit 40 operable to transfer the visible images formed on the image holding members 23C, 23M, 23Y and 23K to a recording medium (M) and a fixing unit 50 configured to fix the transferred image onto the recording medium (M).

The image forming apparatus 1 may further include a body housing 60 accommodating one or more of the afore-described components. In the body housing 60, a body frame (not shown) may be provided to position and/or support the components of the image forming apparatus 1.

The paper feeding unit 10 may include a paper feeding cassette 11 detachably received in the body housing 60 and a first pickup roller 13 which picks up and feeds a recording medium (M) stored in the paper feeding cassette 11 one by one, and conveying the picked up recoding medium (M) to registration roller(s) 15.

The registration roller(s) 15 operate(s) to align the leading edge of the recording medium (M) and to further conveys the aligned recording medium (M) toward the transfer unit 40 at certain time. An image is formed on one side of the recording medium (M) while it passes through the transfer unit 40 and the fixing unit 50.

The duplex roller(s) 17 are configured to feed the recording medium (M), one side of having formed thereon an image, in the reverse direction for forming images on both sides of the recording medium (M) as required. The recording medium (M) fed by the duplex roller(s) 17 is conveyed back to the transfer unit 40 by the registration roller 15 at the appropriate time for forming an image on the other side of the recording medium (M).

The paper feeding tray 19 may be movably supported on the body housing 60. Recording media (M) may be loaded on the paper feeding tray 19 rotated away from the body housing 60 to provide a loading surface. Recording media (M) loaded on the paper feeding tray 19 may be picked up by a second pickup roller 14, and may be fed toward the registration roller(s) 15. The transport path of a recording medium (M) picked up by the second pickup roller 14 from the paper feeding tray 19 may thus share a portion of the reverse transport path of a recording medium (M) fed by the duplex roller(s) 17.

The image forming cartridges 20C, 20M, 20Y and 20K may correspond to a plurality of colors, respectively. For example, the image forming cartridges 20C, 20M, 20Y and 20K may respectively correspond to developers of black, cyan, magenta and yellow, and may each be detachable from the body housing 60 for replacement.

The image forming cartridges 20C, 20M, 20Y and 20K may include respective cartridge housings 21C, 21M, 21Y and 21K for storing developer of corresponding respective color, the image holding members 23C, 23M, 23Y and 23K on which visible images of the developer correspondingly stored in the cartridge housings and development rollers 25C, 25M, 25Y and 25K configured to respectively supply the developer to the image holding members 23C, 23M, 23Y and 23K.

The exposure unit 30 exposes the image holding members 23C, 23M, 23Y and 23K with light to thereby form electrostatic latent images thereon. The development rollers 25C, 25M, 25Y and 25K apply the developer of respective colors to develop the electrostatic latent images into visible images.

The transfer unit 40 transfers the visible images from the image holding members 23C, 23M, 23Y and 23K to a recording medium (M). According to an embodiment that employs an intermediate transfer method, the transfer unit 40 may include an intermediate transfer belt 41 arranged to rotate in an endless loop and in contact with the image holding members 23C, 23M, 23Y and 23K in such a manner the visible images from the image holding member are transferred to the intermediate transfer belt 41 overlapping one another. The transfer unit 40 may further include a driving roller 43 driving the intermediate transfer belt 41 to rotate and a final transfer roller 45*a* for transferring the overlapped visible images from the intermediate transfer belt 41 to a recording medium (M), a transfer backup roller 45*b* arranged to oppose the final transfer roller 45*a* and a tension roller 47 for providing tension to the intermediate transfer belt 41.

The transfer unit 40 may further include intermediate transfer rollers 49C, 49M 49Y and 49K arranged to oppose respectively the image holding members 23C, 23M, 23Y and 23K with the intermediate transfer belt 41 interposed therebetween to affect the transfer of the visible images from the image holding members 23C, 23M, 23Y and 23K to the intermediate transfer belt 41.

Figure 2:
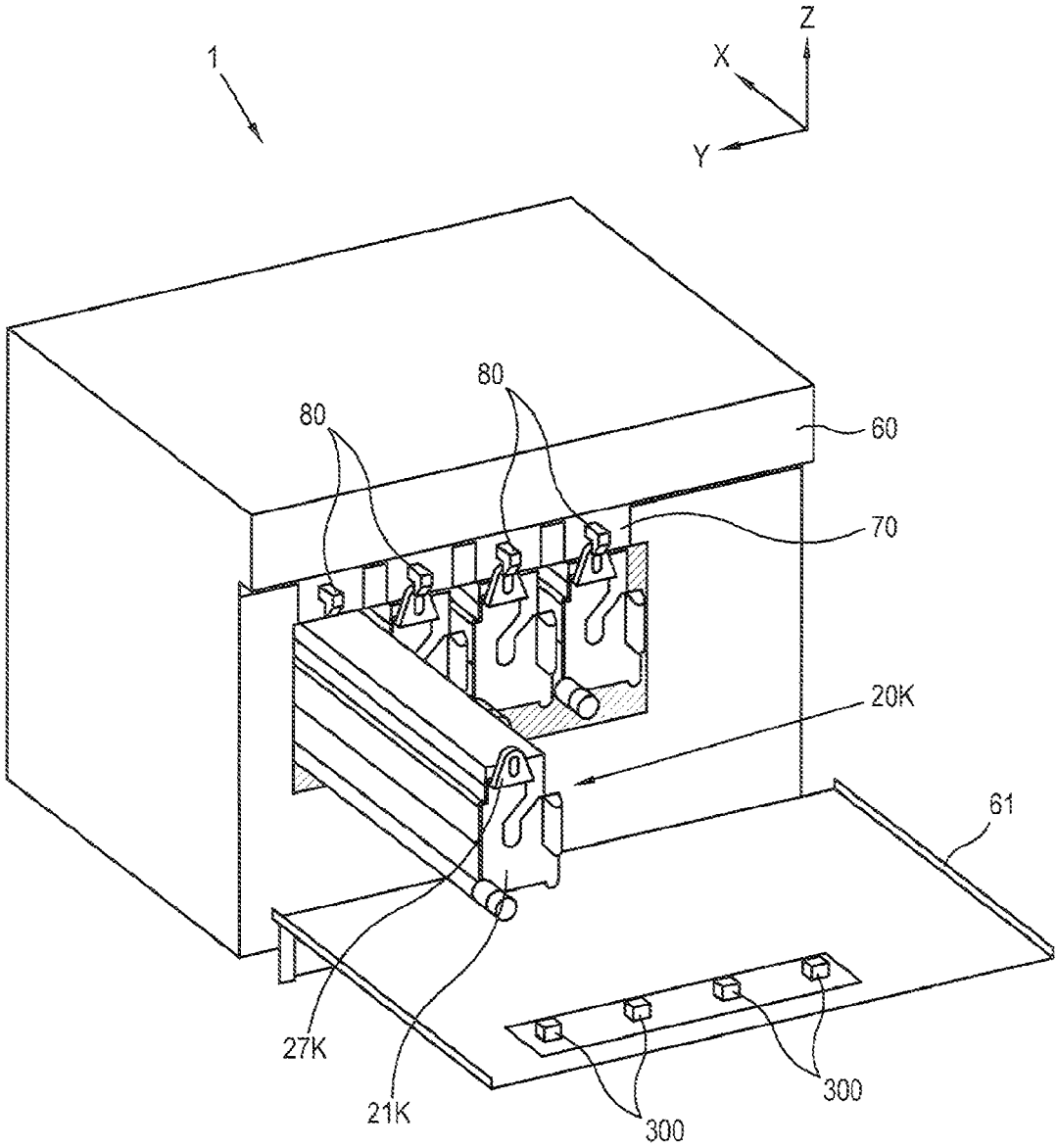
FIG. 2 is a perspective view illustrative of mounting of an image forming cartridge in the image forming apparatus of FIG. 1.

FIG. 2 illustrates the mounting of the image forming cartridges 20C, 20M, 20Y and 20K in the image forming apparatus 1 according to an embodiment. Referring to FIG. 2, the image forming apparatus 1 may include an opening on one side of the body housing 60, through which opening the image forming cartridges 20C, 20M, 20Y and 20K are received to be mounted or removed for replacement. A body frame 70 may be provided in the body housing 60 for supporting and/or properly arranging the image forming cartridges 20C, 20M, 20Y and 20K in relation to the other components.

To mount the image forming cartridges 20C, 20M, 20Y and 20K in the body frame 70, a user moves the image forming cartridges 20C, 20M, 20Y and 20K into the body housing 60 along the X direction, and closes the cover 61. To detach the image forming cartridges 20C, 20M, 20Y and 20K from the body frame 70, the user opens the cover 61, and moves the image forming cartridges 20C, 20M, 20Y and 20K away from the body housing 60 along the −X direction.

In order to reduce the movement of the image forming cartridges 20C, 20M, 20Y and 20K in the direction of separating from the body frame 70, i.e., in the −X direction in FIG. 2, for various reasons even after being mounted in the body frame 70, an image forming apparatus 1 according to an embodiment of the present disclosure may include support assemblies 80 to support the image forming cartridges 20C, 20M, 20Y and 20K mounted in the body frame 70.

The support assemblies 80 support the image forming cartridges 20C, 20M, 20Y and 20K so as not to move or separate once the image forming cartridges are properly mounted in the body frame 70. The support assemblies 80 support the cartridge housings 21C, 21M, 21Y and 21K of the image forming cartridges.

According to an embodiment, the image forming cartridges 20C, 20M, 20Y and 20K may each include a cartridge pressed part 27 protruding at one end of the respective cartridge housings 21C, 21M, 21Y and 21K, i.e., at the ends in the −X direction, for allowing the image forming cartridges to be supported by the support assemblies 80. The cartridge pressed part 27 is formed with a hole 29 (see FIG. 3) through which a position detection protrusion (not shown) projecting from the body frame 70 passes in order to verify that the image forming cartridges 20C, 20M, 20Y and 20K are at the proper position when completely mounted in the body frame 70.

As also shown in FIG. 2, an image forming apparatus according to an embodiment may further include pressing members 300 formed on one side of the cover 61 facing the image forming cartridges 20C, 20M, 20Y and 20K. The pressing members 300 which will be explained later in greater detail.

Figure 3:
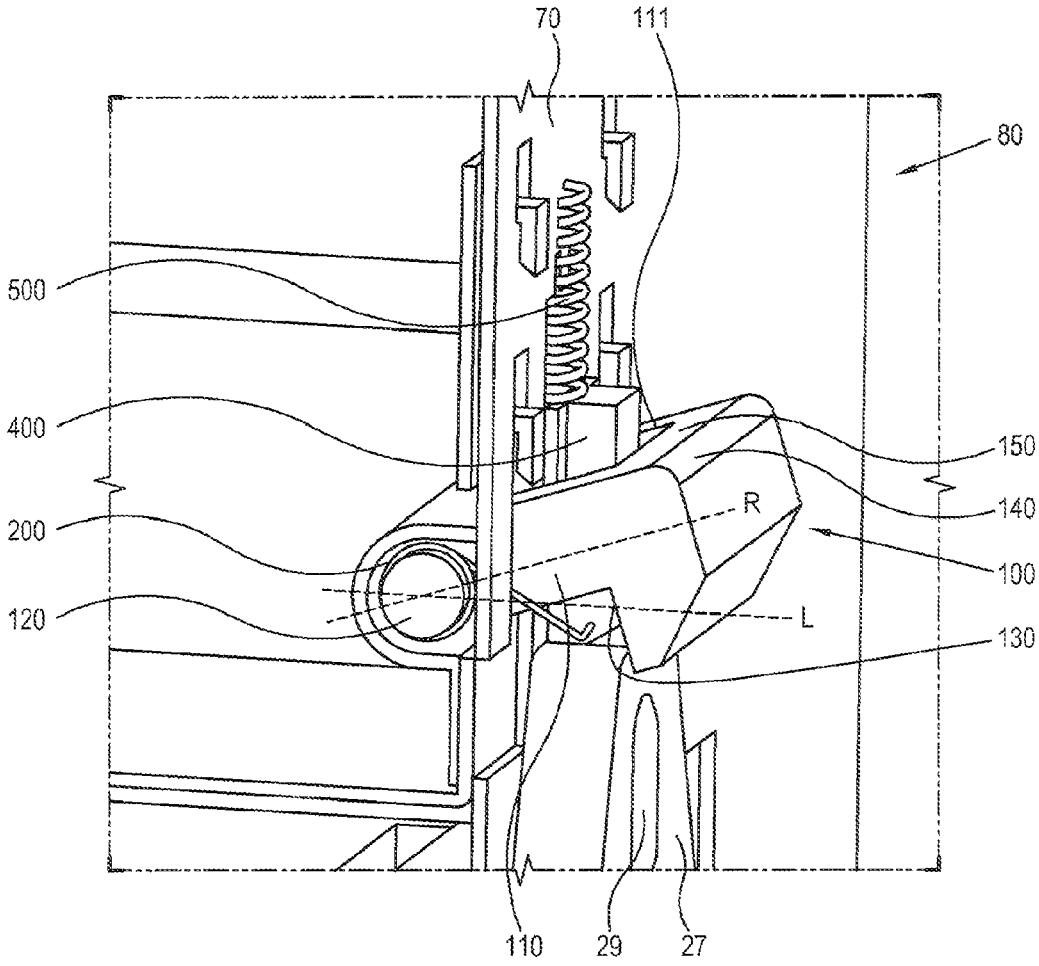
FIG. 3 is a perspective view illustrative of relevant portions of a support assembly of the image forming cartridge of FIG. 2.

Referring now to FIG. 3, the support assembly 80 according to an embodiment will be described in greater detail. In the following description, while, for the sake of brevity, only the support assembly 80 corresponding to the image forming cartridge 20K is explained, it should be understood that the same description may be equally applicable to the other support assemblies 80 corresponding to the other image forming cartridges 20C, 20M and 20Y.

The support assembly 80 according to an embodiment, and as shown in FIG. 3, may include a locking member 100, which is movably coupled to the body frame 70, and which is configured to lock the cartridge pressed part 27 of an image forming cartridge and a first elastic member 200 elastically biasing the locking member 100 in the direction of releasing the locking relationship with the cartridge pressed part 27. A pressing member 300 shown in FIG. 2 presses against the locking member 100 when the cover 61 is closed.

With the above configuration, the support assembly 80 is capable of reducing the separation of the image forming cartridge 20K from the body frame 70 when it is mounted in the body frame 70. Further, since the locking member 100 is biased by the first elastic member 200 in the direction of releasing the lock between the locking member 100 and the cartridge pressed part 27 rather than in the direction of locking the image forming cartridge 20K, a less amount of force is required from a user when mounting and/or detaching the image forming cartridge 20K.

The support assembly 80 may further include a cartridge pressing member 400 that is configured to press the cartridge pressed part 27 in the direction of the transfer unit 40, and may also include a second elastic member 500 that elastically biases the cartridge pressing member 400.

Accordingly, the support assembly 80 presses the image forming cartridge 20K toward the transfer unit to reduce the up and down movement of the image forming cartridge 20K, that is the movement of the image forming cartridge 20K toward and away from the transfer unit, thereby allowing a more stable transfer of the visible image from the image holding member 23K to the transfer unit, for example, to the intermediate transfer belt 141.

According to an embodiment, the locking member 100 may include a locking member body 110 extending away from the body frame 70, that is, in the −X direction, a hinge 120 formed at one end portion of the locking member body 110, with which the locking member body 110 is movably coupled to the body frame 70, and a stopper 130 formed at the other end portion of the locking member body 110 for regulating the movement of the cartridge pressed part 27 in the −X direction.

The locking member 100 may includes a first contact part 140 that makes the initial contact with the pressing member 300 as the cover 61 closes and a second contact part 150 adjacent the first contact part 140 that is in contact with the pressing member 300 when the cover 61 is completely closed.

The locking member 100 rotates about the hinge 120 between a locking position (L) and a releasing position (R). When the locking member 100 is in the locking position (L), the movement of the cartridge pressed part 27 in the −X direction is regulated by the stopper 130 so that the image forming cartridge 20K is locked into position. When the locking member 100 is in the releasing position (R), the image the stopper 130 does not interfere with the movement of the forming cartridge 20K so that the image forming cartridge 20K is allowed to move to be mounted into, and/or detached from, the body frame 70.

That is, during the mounting of the image forming cartridge 20K on the body frame 70, the locking member 100 remains in the releasing position (R) so as not to interfere with the movement of the image forming cartridge along the moves in the X direction. Once the image forming cartridge 20K is fully mounted in the body frame 70, the locking member 100 may move to the locking position (L) to regulate the movement of the cartridge pressed part 27 in the −X direction.

According to an embodiment, such movement of the locking member 100 may be achieved by the provision of the first elastic member 200 and the pressing member 300.

The first elastic member 200 may be, for example, without limitation, may be a torsion spring arranged in the hinge 120 or coupled to the body frame 70, and elastically biases the locking member 100 toward the releasing position (R). In order to allow the mounting of the image forming cartridge 20K in the body frame 70, when the cover 61 is open, the locking member 100 is kept at the releasing position (R) by the first elastic member 200 so as not to interfere with the movement of the cartridge pressed part 27.

The cartridge pressing member 400, under the elastic bias of the second elastic member 500, presses the cartridge pressed part 27 in the −Z direction to prevent the image forming cartridge 20K from moving up and down. In order not to interfere with the movement of the cartridge pressing member 400, a hole 111 may be formed in one area of the locking member body 110, or alternatively the locking member 100 and the cartridge pressing member 400 may be disposed separately from each other. In the illustrated example, the direction along which the cartridge pressing member 400 presses the cartridge pressed part 27 may be perpendicular to the direction of mounting/detaching movement of the image forming cartridge 20K.

With such configuration, the elastic bias to be overcome when mounting the image forming cartridge 20K in the body frame 70 is the elastic force of the second elastic member 500, but not of the first elastic member 200, allowing a user to easily mounts the image forming cartridge 20K.

Figure 4:
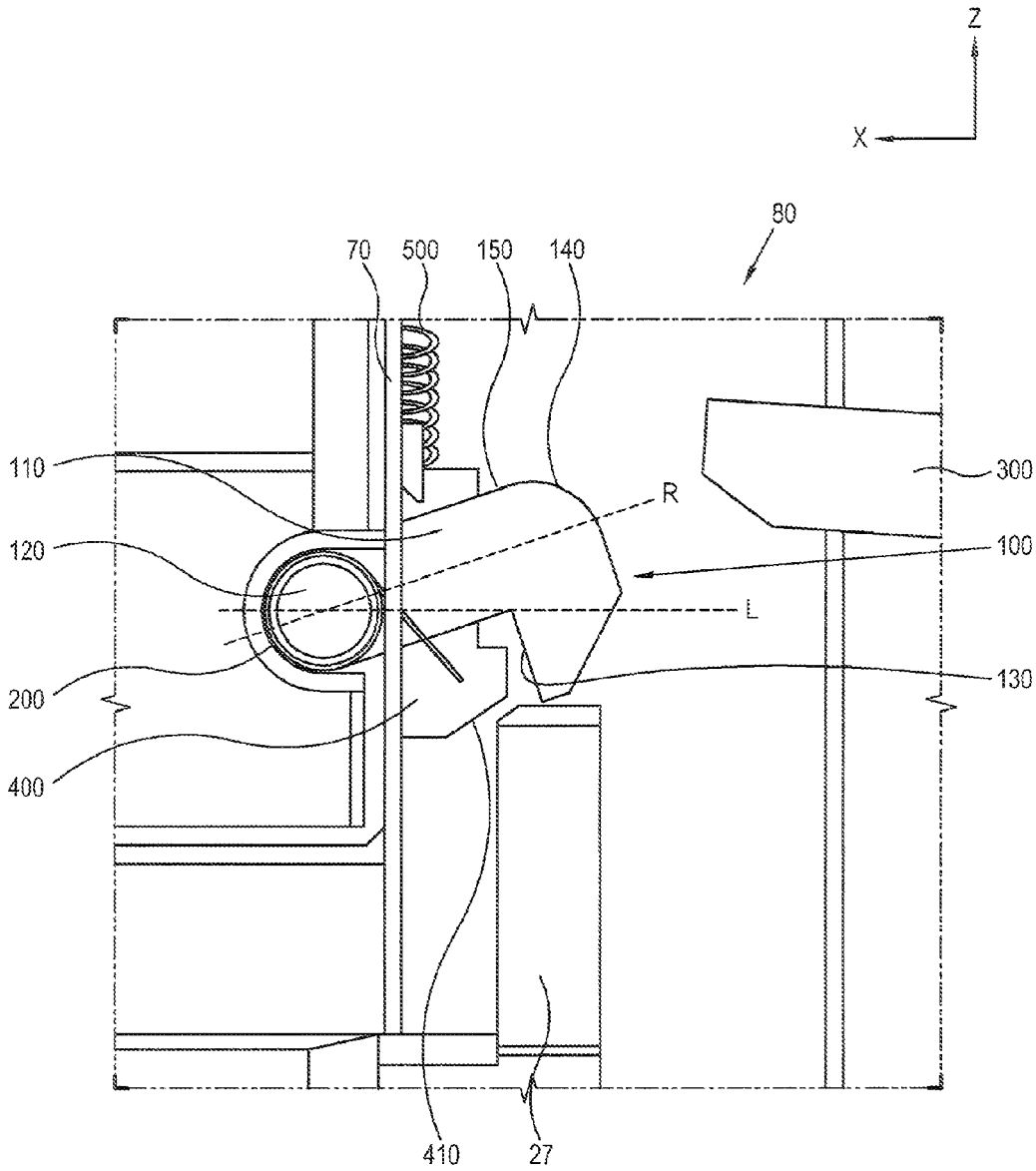
FIGS. 4 to 7 illustrate the operation of the support assembly for supporting the image forming cartridge during various stages of mounting the image forming cartridge in the image forming apparatus according to an embodiment of the present disclosure.

FIGS. 4 to 7 are illustrative of the operation of the support assembly 80 in various stages of the mounting of the image forming cartridge 20K into the body frame 70. Referring to FIG. 4, in order to mount the image forming cartridge 20K in the body frame 70, a user opens the cover 61, and moves the image forming cartridge 20K into the body frame 70 in the X direction.

As the locking member 100 remains in the releasing position (R) due to the elastic bias of the first elastic member 200, the cartridge pressed part 27 can move in the X direction without being interfered by the locking member 100.

The surface of the cartridge pressing member 400 that initially comes in contact with the cartridge pressed part 27 may be inclined, for example, as the slant part 410, which allows an easier movement of the cartridge pressed part 27 in the X direction, overcoming the elastic bias of the second elastic member 500.

Figure 5:
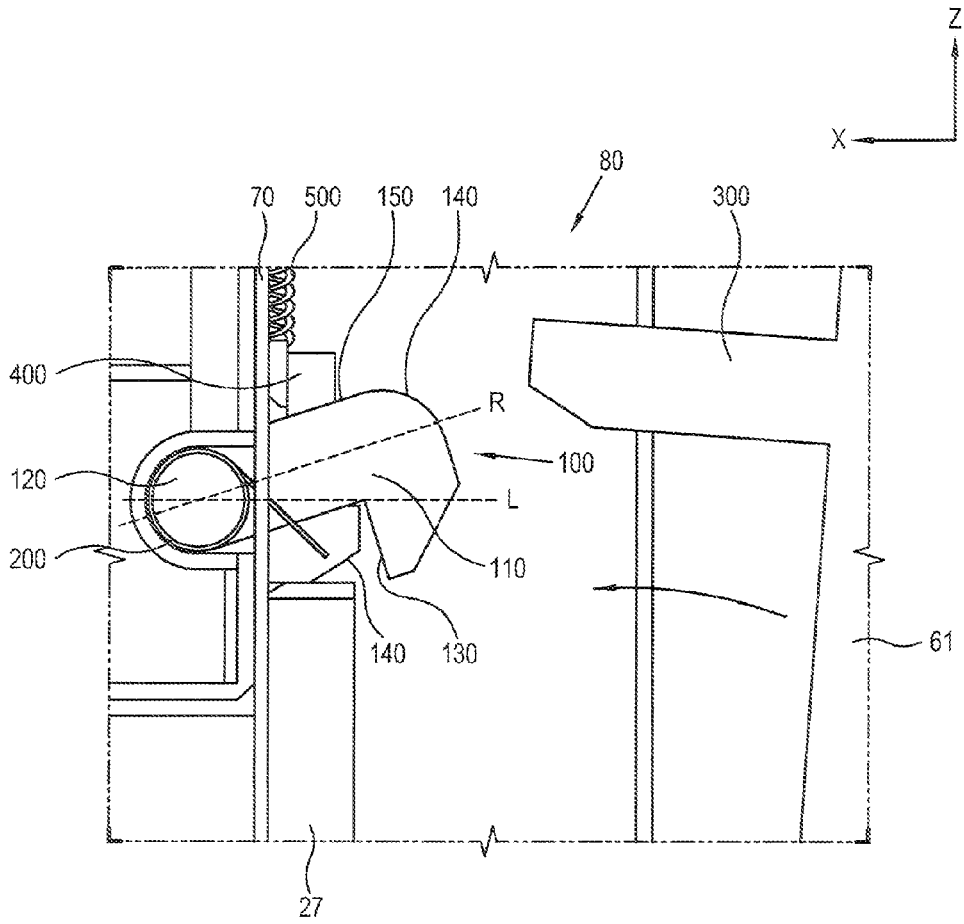

FIG. 5 illustrates the cartridge pressed part 27 being pressed by the cartridge pressing part 400 when the image forming cartridge 20K is received fully in the body frame 70. As shown in FIG. 5, as the cartridge pressed part 27 overcomes the elastic bias of the second elastic member 500, and as the image forming cartridge 20K is thus allowed to move completely into the body frame 70, the cartridge pressed part 27 is pressed by the cartridge pressing member 400 in the −Z direction, thereby reducing the up and down movements of the image forming cartridge 20K.

When the image forming cartridge 20K is completely mounted, the user closes the cover 61, causing the pressing member 300 protruding from the inner side of the cover 61 to approach the locking member 100, which is still in the releasing position (R).

Figure 6:
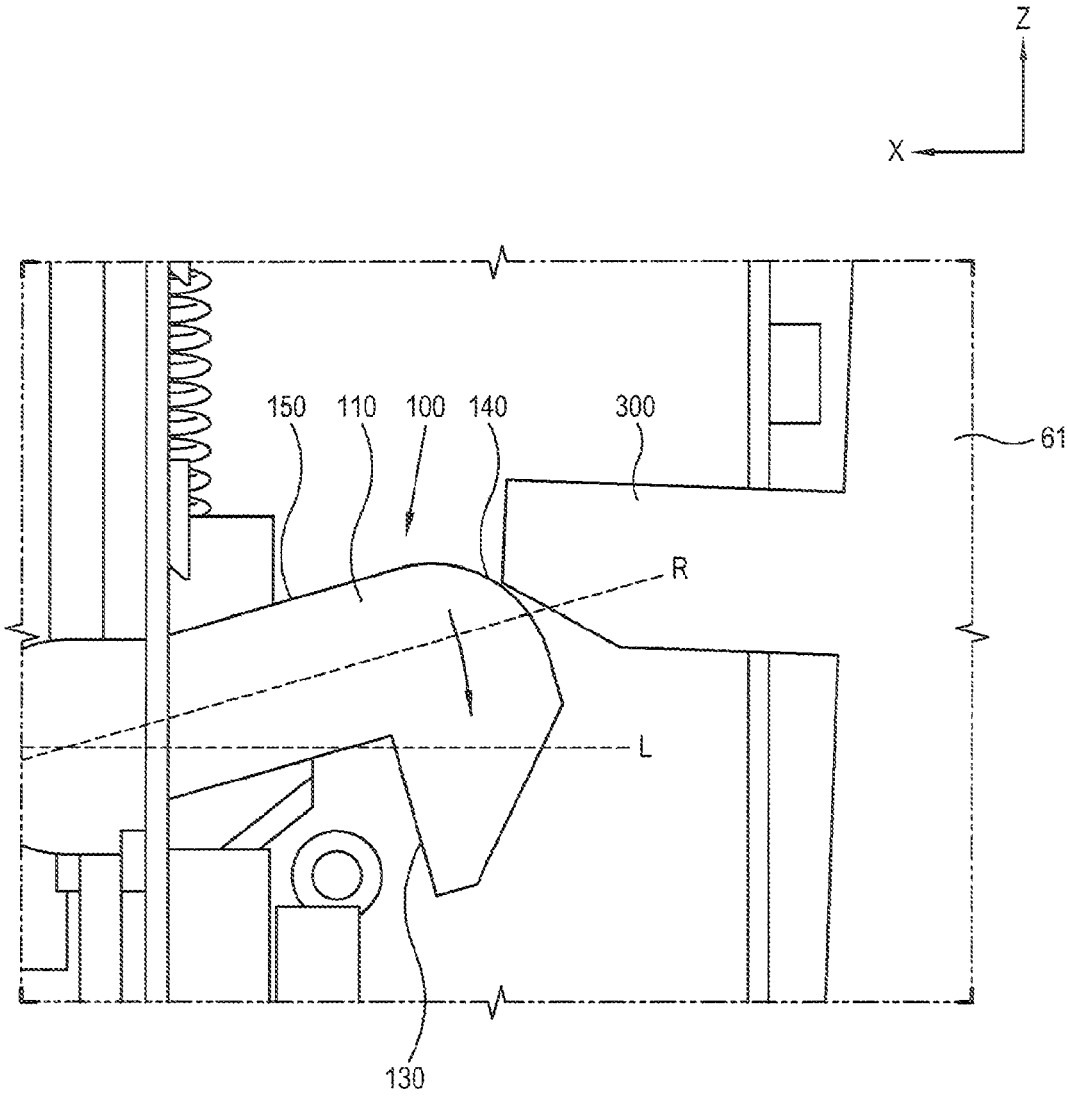

FIG. 6 illustrates the pressing member 300 initially coming into contact with the locking member 100 as the cover 61 moves further in the closing direction. As shown in FIG. 6, as the cover 61 moves, an end portion of the pressing member 300 initially comes in contact with the first contact part 140 of the locking member 100. The further movement of the pressing member 300 in the X direction, which is guided slidingly by the first contact part 140, causes the locking member 100 to overcome the elastic bias of the first elastic member 200, and as a result to move from the releasing position (R) to the locking position (L). Accordingly to an embodiment, in order to make such sliding movement of the pressing member 300 easier, the first contact part 140 may be formed to be slanted or rounded.

Figure 7:
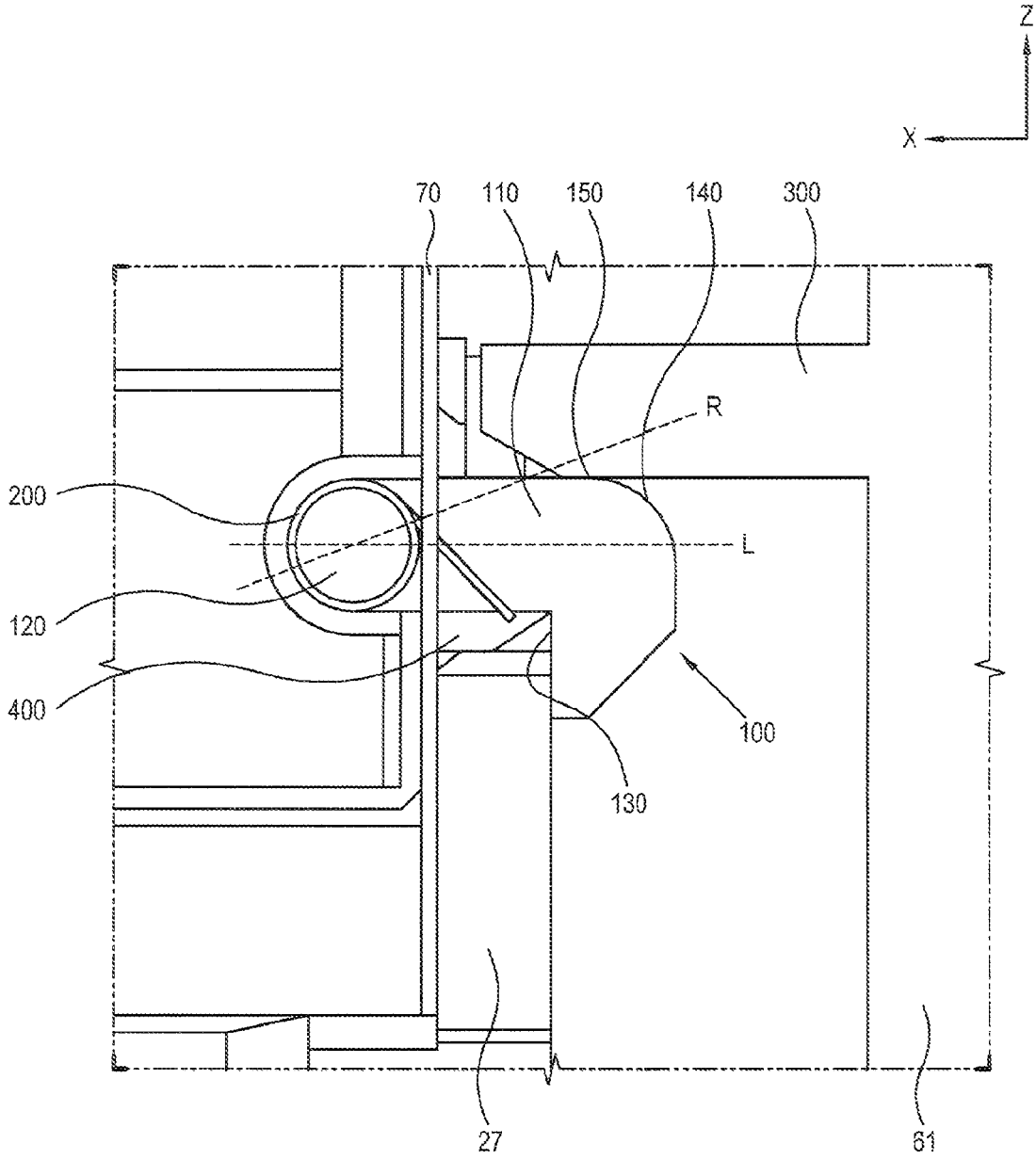

FIG. 7 illustrates the cover 61 being completely closed. As shown in FIG. 7, when the cover 61 completely covers the body frame 70, the pressing member 300 has moved further in the X direction to be in contact with the second contact part 150 on the upper portion of the locking member 100, opposing the elastic bias of the first elastic member 200 to thereby allow the locking member 100 to be in the locking position (L).

When the cover 61 is closed, the pressing member 300 prevents the locking member 100 from returning to the releasing position (R), causing the locking member 100 to remain in the locking position (L). When the locking member 100 is in the locking position (L), the stopper 130 opposes and thus limits the movement of the cartridge pressed part 27, and thus the movement of the image forming cartridge 20K, in the −X direction, thus preventing the image forming cartridge 20K from being separated from the body frame 70 due to the vibration in the image forming apparatus 1 or to an external impact.

Further, since the cartridge pressing member 400 presses the cartridge pressed part 27 in the −Z direction, it is possible to reduce the movement of the image forming cartridge 20K along both the X and Z directions.

In order to detach the image forming cartridge 20K from the body frame 70 for, for example, maintenance or replacement, the user first opens the cover 61. When the cover 61 is open, the pressing member 300 is separated from the locking member 100, causing the locking member 100 to move from the locking position (L) back to the releasing position (R) due to the elastic force of the first elastic member 200.

With the locking member 100 being in the releasing position (R), the user is able to move the image forming cartridge 20K in the −X direction, and remove the image forming cartridge 20K from the body frame 70.

As described above, by closing the cover 61, the locking member 100 may be maintained in the locking position (L) by the pressing member 300, thereby preventing the image forming cartridge 20K from being separated from the body frame 70 during when the image forming apparatus 1 is in operation.

Figure 8:
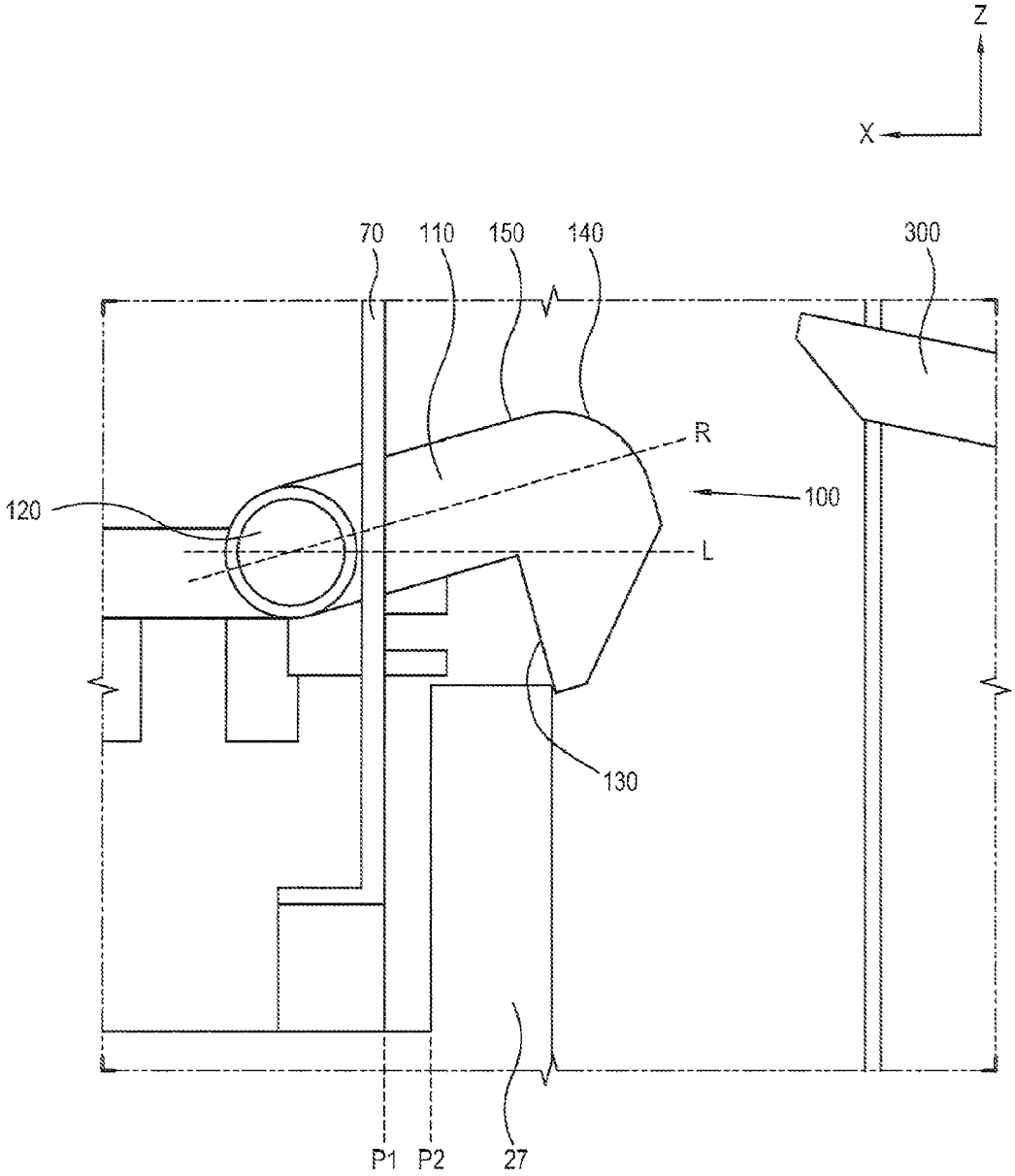
FIG. 8 illustrates the state of a cover when the image forming cartridge is not properly mounted in the image forming apparatus according to an embodiment of the present disclosure.

FIG. 8 illustrates the situation where the cover 61 is closed without the image forming cartridge 20K being completely mounted in the body frame 70. In FIG. 8, the proper position of the cartridge pressed part 27 when the image forming cartridge 20K is properly mounted in the body frame 70 is indicated as the position P. If prior to closing the cover 61, the user has failed to fully mount the image forming cartridge 20K so as to result in the cartridge pressed part 27 being positioned at the position P2 away from the position P1, and if the cover 61 is closed in such a state, so long as the cartridge pressed part 27 is in contact with at least a portion of the stopper 130 when the pressing member 300 contacts the locking member 100, the pressing member 300 causes the locking member 100 to move to the locking position (L), and in turn cause the cartridge pressed part 27 to move in the X direction. That is, the pressing member 300 pressing on the locking member 100 results in the portion of the stopper 130 in contact with the cartridge pressed part 27 causing the cartridge pressed part 27 to move from the position P2 into the properly mounted position P1. Accordingly, even when the user has fail to place the image forming cartridge 20K in the proper mounting position P1, the image forming cartridge 20K can nevertheless be properly mounted by closing the cover 61.

As described above, according to one or more aspects of the present disclosure, a support structure for a removable cartridge of an image forming apparatus may include a locking member locking the removable cartridge in the properly mounted position and a pressing member provided in a cover for pressing the locking member into the locking position when cover is closed, thereby preventing an undesirable separation of the removable cartridge from the image forming apparatus.

According to one or more aspects of the present disclosure, the looking member may be elastically biased in the direction of releasing, rather than maintaining, the locking relationship with the removable cartridge so as to allow an easier mounting of the removable cartridge.

According to one or more aspects of the present disclosure, even when the user fails to properly position the removable cartridge in the image forming apparatus, the closing of the cover results in the removable cartridge moving into the proper mounting position, thus realizing improved reliability and/or reduced likelihood of degradation in the image quality.

According to one or more aspects of the present disclosure, portions of the contact surfaces of the support structure can be slanted or rounded for added convenience in mounting of the removable cartridge in the image forming apparatus.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. An image forming apparatus, comprising:

a body housing having an opening and a cover configured to selectively cover the opening;

a body frame arranged in the body housing for supporting thereon one or more components of the image forming apparatus;

an image forming cartridge configured to form thereon a visible image and to be detachably mountable on the body frame, the image forming cartridge being receivable into the body housing through the opening; and a support assembly for supporting the image forming cartridge mounted on the body frame, wherein the support assembly comprises:

a locking member movable between a locking position at which the locking member prevents the image forming cartridge from moving in a direction away from the body frame and a releasing position at which the locking member allows the image forming cartridge to move away from the body frame;

an elastic member elastically biasing the locking member toward the releasing position; and a pressing member provided on the cover in such a manner that the pressing member presses on the locking member so as to cause the locking member to remain in the locking position when the cover is closed to cover the opening of the body housing.

2. The image forming apparatus according to claim 1, wherein the locking member comprises a locking member body, a hinge movably coupling a first end portion of the locking member body to the body frame and a stopper formed at a second end portion opposite the first end portion of the locking member body, the stopper being in an interfering contact with and thereby limiting movement of the image forming cartridge that is mounted on the body frame.

3. The image forming apparatus according to claim 2, wherein the image forming cartridge comprises a cartridge housing and a cartridge pressed part formed on the cartridge housing, the cartridge pressed part being configured to come into a locking contact with the stopper of the locking member.

4. The image forming apparatus according to claim 3, wherein the cartridge pressed part of the image forming cartridge and the stopper of the locking member are configured and arranged such that, when the stopper is able to come into a contact with any portion of the cartridge pressed part, closing of the cover causes the pressing member to press the locking member to move toward the locking position, and in turn causes the image forming cartridge to move from a first position to a second position closer to the body frame through such contact between the stopper and the cartridge pressed part.

5. The image forming apparatus according to claim 2, wherein the locking member body comprises a curved contact surface, the curved contact surface coming into initial contact with the pressing member when the cover is being closed.

6. The image forming apparatus according to claim 2, wherein the locking member body comprises an inclined contact surface, the inclined contact surface coming into initial contact with the pressing member when the cover is being closed.

7. The image forming apparatus according to claim 1, further comprising a transfer unit supported on the body frame to correspond to the image forming cartridge, the transfer unit being configured to transfer the visible image from the image forming cartridge onto a recording medium, wherein the support assembly further comprises a cartridge pressing member arranged on the body frame, the cartridge pressing member being configured to elastically press the image forming cartridge toward the transfer unit.

8. The image forming apparatus according to claim 7, wherein the cartridge pressing member comprises an inclined contact guide surface, the inclined contact guide surface coming into initial contact with the image forming cartridge when the image forming cartridge is being received into the body housing.

9. The image forming apparatus according to claim 7, wherein a first direction in which the cartridge pressing member elastically presses the image forming cartridge is perpendicular to a second direction in which the image forming cartridge is received into the body housing.

10. An image forming apparatus having a housing with an opening through which to detachably receive a removable component unit of the image forming apparatus and a cover for selectively closing the opening, comprising:

a support frame arranged in the housing, the support frame defining a mounting position of the removable component unit at which the removable component unit received into the housing is to be operably supported on the support frame;

a locking member movable between a locking position and a releasing position, the locking member limiting a movement of the removable component unit away from the mounting position when the locking member is in the locking position, the locking member allowing the removable component unit to move away from the mounting position when the locking member is in the releasing position;

an elastic member elastically biasing the locking member to move toward the releasing position; and a pressing member extending from the cover to be in a pressing contact with the locking member in such a manner to cause the locking member to remain in the locking position when the cover is closed.

11. The image forming apparatus of claim 10, wherein the removable component unit comprises an image forming cartridge that includes an image holding member having an image carrying surface on which an image formed of developer is to be supported.

12. The image forming apparatus of claim 11, wherein the removable component unit further comprises a developer container having stored therein a supply of developer and a development roller for conveying the developer from the developer container to the image carrying surface of the image holding member to thereby form thereon the image formed of developer.

13. The image forming apparatus of claim 10, wherein the locking member comprises a locking member body pivotally coupled to the support frame, the locking member body having a stopper formed on an end portion thereof that is configured to come into contact with a portion of the removable component unit being received into the housing, the stopper defining a contact surface that extends perpendicular to a direction along which the removable component unit is received into the housing.

14. The image forming apparatus of claim 13, wherein the locking member body further comprises a contact guide surface configured to make an initial contact with the pressing member of the cover being closed, the contact guide surface being curved to guide the pressing member to move slidingly thereon toward the support frame.

15. The image forming apparatus according to claim 13, wherein the locking member is configured and arranged such that, when the locking member is able to come into a contact with any portion of the removable component unit, movement of the locking member toward the locking position urged by the pressing member of the cover being closed causes the removable component unit to move from a position away from the mounting position toward the mounting position to thereby be operably supported on the support frame in the mounting position when the cover is completely closed.

16. The image forming apparatus of claim 10, further comprising:

an elastic pressing member configured to elastically press the removable component unit received in the housing along a first direction perpendicular to a second direction along which the removable component unit is received into the housing.

17. The image forming apparatus of claim 10, wherein the elastic member comprises a torsion spring that biases the locking member to pivot about a hinged coupling with the support frame so as to move toward the locking position.

* * * * *